United States Patent [19]

Okuya et al.

[11] 4,426,634

[45] Jan. 17, 1984

[54] VARIABLE RESISTANCE DEVICE

[75] Inventors: Tsutae Okuya; Yoshiyuki Ito, both of Miyagi, Japan

[73] Assignee: Alps Electric Co., Ltd., Tokyo, Japan

[21] Appl. No.: 372,199

[22] Filed: Apr. 26, 1982

[30] Foreign Application Priority Data

Apr. 28, 1981 [JP] Japan ..... 56-62009[U]

[51] Int. Cl.[3] ..... H01C 10/30

[52] U.S. Cl. ..... 338/161; 338/176; 338/196

[58] Field of Search ..... 338/160, 161, 119, 196, 338/165, 176

[56] References Cited

U.S. PATENT DOCUMENTS 3,909,770 9/1975 Oka et al. ..... 338/196 X

*Primary Examiner*—C. L. Albritton

*Attorney, Agent, or Firm*—Guy W. Shoup; Gerard F. Dunne

[57] ABSTRACT

A variable resistance device wherein a slide member is disposed slidably within an elongated case, resistance and collector elements are disposed on an insulating substrate, and a contactor attached to the slide member rides over the resistance and collector elements. A common conductor and a pair of staggered change-over conductor strips are also disposed parallel to each other on the substrate, and a pair of change-over contactors engage with the common conductor and one of the change-over conductors, respectively. A pair of polar light source means disposed within the operating means of the slide member are connected in parallel with opposite polarity, and connected in common to the change-over contactors. One of the change-over contactors engages alternately with one or the other of the change-over conductors in accordance with the linear movement of the slide member, thereby the light source means changes its light alternately.

13 Claims, 9 Drawing Figures

VARIABLE RESISTANCE DEVICE

BACKGROUND OF THE INVENTION

The present invention relates to a variable resistance device, and more particularly to a variable resistance device of a type having a slide movable linearly for actuation of the switch and a pair of light sources activated alternately in accordance with the motion of the slide.

The conventional linear mortion variable resistance devices used in frequency equalizers of audio reproducing systems or the like are generally provided with detent means for indicating the level of amplification or attenuation of several selected reproduced audio frequency bands, so that visual recognition of such levels is not possible.

SUMMARY OF THE INVENTION

An object of the present invention is to eliminate the inconveniences in the conventional variable resistance devices.

Another object of the present invention is to provide a variable resistance device which may indicate the amplification or attenuation level by alternately lighting two light sources so that such a level can be visually recognized.

A further object of the present invention is to provide a linear motion variable resistance device provided with means for indicating the level of amplification or attenuation of audio frequencies, which device is simple in construction and is easy to assemble.

The frequency equalizer system used in typical audio reproducing systems indicates the frequency response for each of several selected audio frequency ranges, and consists of a plurality of tone control circuits, each of which has a variable resistance control means for which the present invention may be used. The variable resistance control means typically includes a resistance element and a conductive strip, and one end of each of the resistance element and first conductor strip are typically connected to control means for changing the attenuation level of a selected audio frequency, for instance, 1 KHz.

Briefly stated, according to the present invention, a resistance element and a collector strip, which, for example, may form part of a tone control circuit for a selected frequency, are connected by a sliding contactor riding over them by operation of a slider. A common conductor strip and two conductors having adjacent contact portions are connected with a light source circuit formed by two polar light sources. One end of one of the conductors is connected to the positive terminal of a d.c. power supply while one end of the other conductor is connected to the negative terminal of the same power supply. One end of the common conductor strip is connected to the terminal whose potential is approximately half of the voltage of the above-mentioned d.c. power supply. The common conductor is connected by the slider to either one of the two conductors through the polar light sources connected in parallel in opposite polarity. The light sources, therefore, may be lit alternately as the slider is moved.

DESCRIPTION OF THE PREFERRED EMBODIMENTS

Figure 1:
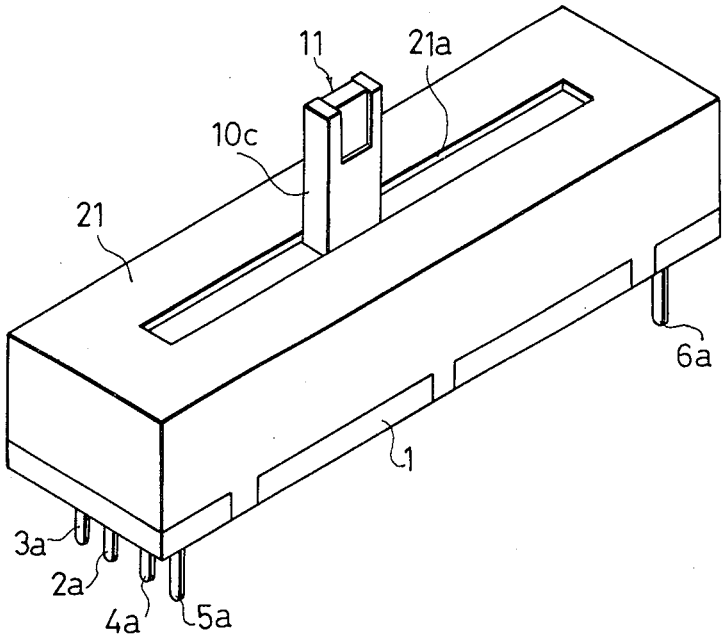
FIG. 1 is a perspective view of a linear motion-type variable resistance device embodying the present invention.

FIGS. 1 through 8 illustrate embodiments of the present invention. In FIG. 1, reference numeral 1 represents an insulating substrate and reference numeral 21 represents a metallic case member caulked to the substrate 1. Reference numeral 21*a* shows a longitudinal opening through which operating means 10*c* of a slide member 10 protrudes.

Figure 2:
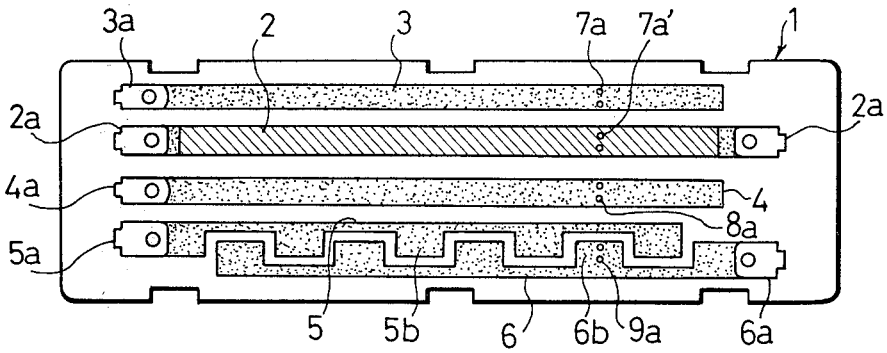
FIG. 2 is a plan view showing a resistance and change-over conductors disposed on an insulating substrate.

In FIG. 2, reference numeral 1 likewise represents the insulating substrate and reference numerals 2 and 3 represent an elongated resistance and a collector for a variable resistance device that are juxtaposed on one side of the insulating substrate in its longitudinal direction. Reference numerals 2*a* and 3*a* represent their terminal electrodes, respectively. Reference numeral 4 represents an elongated common conductor formed on the other side of the insulating substrate 1 in its longitudinal direction, and reference numerals 5 and 6 represent a pair of change-over conductors juxtaposed with each along the side of the common conductors 4. Reference numerals 4*a*, 5*a* and 6*a* represent terminal electrodes for these members 4, 5 and 6, respectively. All of these terminal electrodes protrude downward from the lower face of the insulating substrate 1. A plurality of contact portions 5*b*, 6*b* are formed on the pair of change-over conductors 5, 6 in the longitudinal direction of the insulating substrate 1 in such a fashion that they alternately come adjacent one another with predetermined gaps between them.

Reference numerals 7*a* and 7*a'* represent contact elements of contactor 7 for the variable resistance device that is fixed to the lower face (10*f*) of a slide member 10 that will be described below. The contact element 7*a* comes into sliding contact with the resistance 2 while the element 7*a'* comes into sliding contact with the collector 3 to change the resistance value of the device in this manner. Reference numerals 8*a* and 9*a* represent contact elements of a pair of independent change-over contactors that are held at the center of the lower face 10*f* of the slide member 10, separately from the abovementioned contactor 7 for the variable resistance device. One of the contact elements 8*a* comes into sliding contact with the elongated common conductor 4 and the other comes into sliding contact with the contact portions 5*b*, 6*b* of the pair of change-over conductors 5, 6. These conductors 4, 5, 6 and the contactors 8, 9 coming into the sliding contact with the former are for feeding current to light source means 14, 15 that will be described later.

Figure 3:
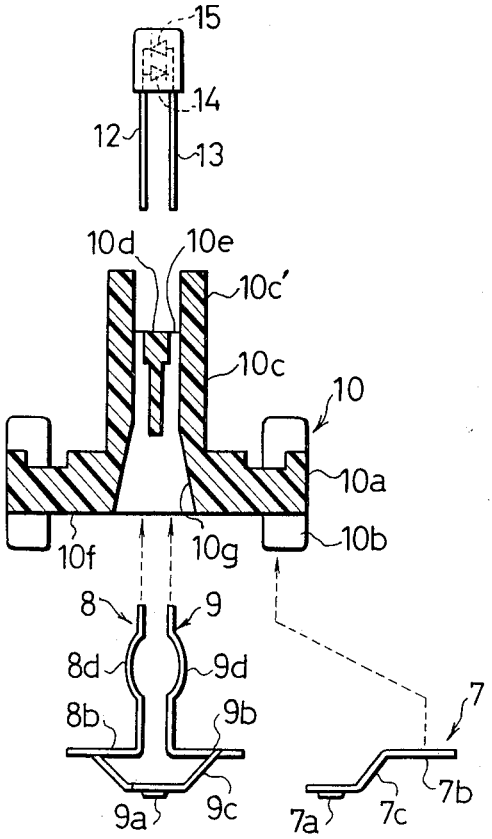
FIG. 3 is an exploded perspective view of members fitted to a slide member.
Figure 4:
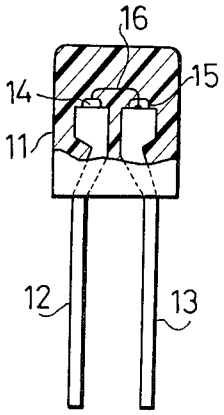
FIGS. 4*a* and 4*b* are front and plan views of light source means.
Figure 4:
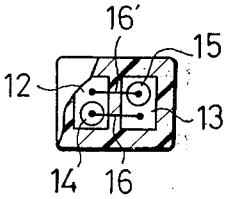

FIG. 3 illustrates the method of mounting the light source means 14, 15 and the contactors 8, 9 on the slide member 10 and the method of connecting the light source means 14, 15 to the terminals 12, 13. FIGS. 4*a* and 4*b* illustrate the construction of the light source means. The light source means of the present invention consists, for example, of a pair of terminals 12, 13 that are molded inside a transparent resin body 11, and two light-emitting diodes (LED) having mutually different emitting colors, whereby the light source means 14, 15 are connected to their terminals 12, 13 by jumper wires 16, 16', respectively.

Reference numeral 10 represents the abovementioned slide member, and reference numeral 10*a* represents a base thereof. Reference numeral 10*b* represents guide legs that are disposed at the four corners of the base 10*a*. Reference numeral 10*c* represents a lever that is implanted in the upper face of the base so as to protrude therefrom, and is equipped at its tip with a pair of bifurcated plates 10*c'* opposing each other. Reference numeral 10*e* represents a pair of through-holes that are disposed inside the lever in its longitudinal direction with a partition 10*d* between them. The through-holes 10*e* are connected to each other by a wide hollow 10*g* on the lower face of the slide member 10.

Next, the method of fitting the light source means 14, 15 and the contactors 7, 8, 9 to the slide member 10 will be described with reference to FIG. 3. While the terminals 12, 13 protruding outward from the resin body 11 are inserted into the pair of through-holes 10*e* of the lever 10*c*, the resin body 11 having the light source means 12, 13 sealed therein is pushed down, whereby the lower face of the resin body comes into contact with the partition and under such state, the light source means 14, 15 is mounted to the slide member 10.

Figure 7:
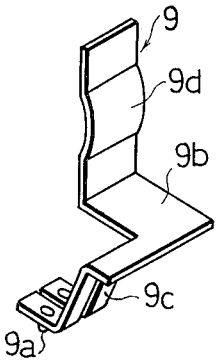
FIG. 7 is a perspective view of an independent terminal.

Next, the contactor 7 having the contact elements 7*a*, 7*a'* fitted, for example, by caulking their fitting portion 7*b* close to one of the legs 10*b* on the lower face 10*f* of the slide member. FIG. 7 shows the shape of a power feed slide contactor. As shown in FIG. 3, a pair of contactors 8, 9 having the same shape are disposed so as to oppose each other, and a pair of upwardly extending resilient arms 8*d*, 9*d* are pushed into the hollow 10*g* from the lower side of the slide member 10 and are further inserted into the holes 10*e* of the lever. The arms 8*d* and 9*d* are brought into resilient contact with the terminals 12 and 15 of the light source means 14 and 15, respectively, inside the holes 10*e* of the lever 10*c*, and the fitting portions 8*b*, 9*b* of the contactors 8, 9 are caulked to the lower face 10*f* of the slide member 10, in such a fashion that the contact elements 7*a*, 7*a'*, 8*a*, 9*a* of these contactors 7, 8, 9 are held on the slide member 10 for synchronous travelling. The slide member 10 is placed in a case fixed to the insulating substrate 1, and the lever 10*c* of the slide member 10 supporting the light source means protrudes outward from an elongated groove defined on the upper face of the case.

Figure 5:
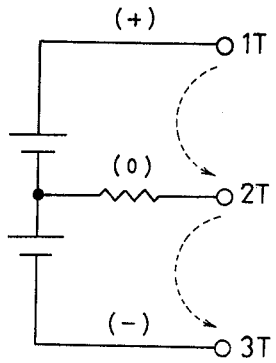
FIGS. 5 and 6 are circuit diagrams useful for explaining the principle of lighting of the light source means.

The slide type variable resistance device equipped with the light source means in accordance with the present invention, which has the construction described above, operates in the following manner to be read with reference to FIGS. 5 and 6. One (5) of the change-over conductors is constantly kept at a positive potential via terminal 1T while the other 6 is kept at a negative potential via terminal 3T. The common conductor 4 is kept, via the terminal 2T, at a potential which is exactly or approximately equal to half of the potential (voltage) difference between the change-over contactors 5 and 6, as shown in FIG. 5. Accordingly, in this circuit, the current constantly flows from 1T to 2T and from 2T to 3T, as indicated by dotted line in the drawing. It will now be assumed that one 8 of the contactors remains in sliding contact with the common conductor 4 and the other 9 remains in sliding contact with an arbitrary contact 5*b* of one 5 of the change-over conductors. In this case, the current flows from 1T to 2T through the contactor 9, the light source means 15 and the contactor 8, so that the light source means 15, which is to emit red, for example, emits that color.

Figure 6:
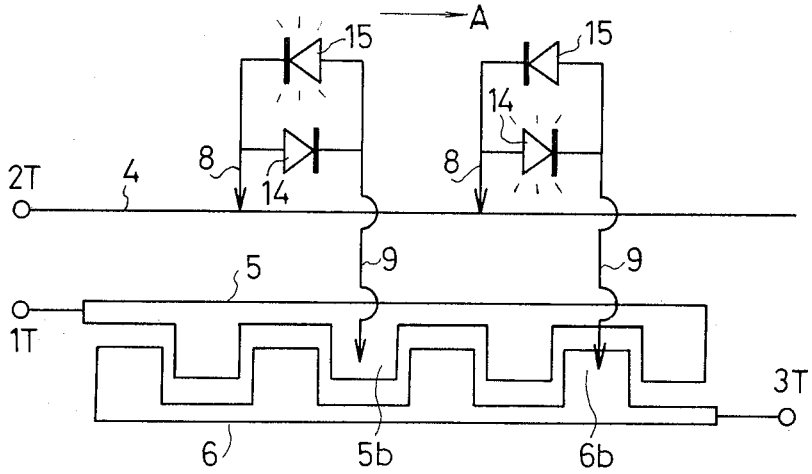

By contrast, when the slide member 10 moves in the direction indicated by arrow A in FIG. 6 and of the power feed contactor 8 is on the common conductor 4 with the other 9 placed in sliding contact with an arbitrary contact 6*b* of the change-over conductor 6, the current flows from 2T to 3T through the contactor 8, the light source means 14, and the contactor 9, so that the light source means 14, which is to emit blue, for example, emits blue light.

Figure 8:
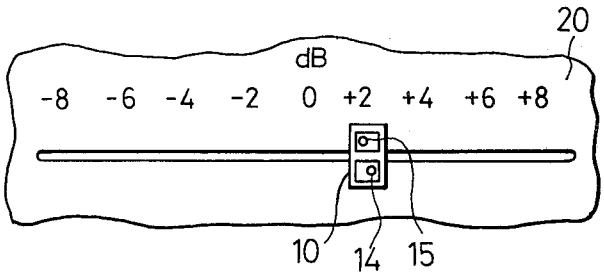
FIG. 8 is a front view of a part of a panel to which a frequency equalizer is fitted.

FIG. 8 illustrates a panel surface 20 when the variable resistance device of the present invention is applied to the aforementioned frequency equalizer of an audio apparatus. In the actual apparatus, a large number of equalizers are provided so as to divide the frequency into a large number of frequency bands and to change the amplification ratio. If the equalizer shown is to regulate the frequency characteristic near 1 KHz, for instance, the "0" position at the center is to obtain a flat characteristic near 1 KHz, and the amplification ratio can be increased or decreased by sliding the slide member to the right or to the left, in the dB scale corresponding to the ratio.

Since the gap of the scale is equal to that of the contact elements 5*a* and 6*a* shown in FIG. 1, the colors of the light source means alternately change with the positions of the scale, making it possible to continuously sense the change in the amplification ratio. This is far easier to use than the prior art system in which sensing is made by means of click feeling. It is also possible to eliminate the contact at the center "0" so that no light source means is lit, thereby representing the state of the flat characteristic.

Though the present invention has been described by primarily referring to the equalizer as an example, it will be obvious to those skilled in the art that this invention can be adapted to various applications by changing the disposition of the change-over conductors or the like.

What is claimed is:

1. A variable resistance device comprising a case member with an open bottom and a longitudinal slot formed at the top thereof;

an insulating substrate attached to said case member at said open bottom so as to define a hollow case;

resistance and collector elements formed on said substrate so as to extend parallel to each other and to said slot;

common conductor means extending on said substrate parallel to said resistance and said collector elements;

first and second change-over conductor elements disposed on said substrate and extending parallel to said common conductor means;

a slide member made of an insulating material and disposed within said case, said slide member being provided with operating means extending upward and outward through said slot and slidable along said substrate;

a contactor attached to said slide member for making sliding contact with said resistance and said collector elements and bridging between them;

first and second change-over contactors attached to said slide member for slidably engaging with said common conductor and one of said change-over conductors, respectively; and a pair of polar light source means disposed within said operating means and connected in series between said change-over conductors, said polar light source means being connected in parallel and in opposite polarity with each other.

2. A variable resistance device according to claim 1, wherein said first and second change-over conductor elements are disposed parallel to and spaced apart from each other;

each of said conductor elements being provided integrally with a plurality of contact portions projecting from one side facing the other conductor and each two adjacent contact portions are spaced apart from each other; and each contact portion is positioned so that said change-over contactor engages alternately with one contact portion projecting from said first change-over conductor and then with the adjacent contact portion projecting from said second change-over conductor in accordance with the movement of said slide member.

3. A variable resistance device according to claim 2, wherein a fixed d.c. voltage is applied across the pair of said change-over conductor elements; and said common conductor means is held at a potential of substantially half said d.c. voltage.

4. A variable resistance device according to claim 3, wherein said light source means have identical electrical properties and emit light of different colors.

5. A variable resistance device according to claim 4, wherein each of said change-over contactors has an arm extending upward, each of said light source means has a pair of conductive leads; and each of said arms is resiliently connected to each of said conductive leads within the longitudinal throughhole of said operating means of said slide member.

6. A variable resistance device according to claim 5, wherein said contact portions are formed so as to be identical in shape and are spaced apart from each other with the same gap and a contact portion belonging to one change-over conductor is interposed into said space between two neighboring contact portions belonging to the other conductor.

7. A variable resistance device according to claim 6, wherein each of said contact portions is shaped as a rectangular projection formed integrally with one of said change-over conductor elements.

8. In a variable resistance device having a resistance element and a conductive collector connected electrically by contact elements carried by a slider adapted to be moved over said resistance element and said conductive collector by actuation of an operation portion; means including a pair of light sources carried by said operation portion for indicating movement of said slider along said resistance element and said conductive collector, said light sources each being adapted to emit light during a flow of current therethrough in one direction only and being connected oppositely in parallel so that said light sources may emit light selectively according to the direction of the flow of current through the parallel connection thereof, said indicating means further including separate conductors arranged along the path of movement of said slider and having respective portions adapted to be connected alternately with said parallel connection of the pair of light sources as said slider is moved along said resistance element and said conductive collector so that said separate conductors may be connected to current sources of opposite polarity to enable said light sources to emit light alternately as said slider is moved along said resistance element and said conductive collector.

9. A device according to claim 8, said conductors being arranged side by side and each having contact portions extending towards the other conductor with the contact portions interlaid.

10. A device according to claim 9, said indicating means further including a common conductor connected electrically to each of said light sources, and means for applying a d.c. voltage across said separate conductors while holding the potential of said common conductor at a level approximately midway between the potentials of the separate conductors.

11. A device according to claim 8, said indicating means further including a common conductor connected electrically to each of said light sources, and means for applying a d.c. voltage across said separate conductors while holding the potential of said common conductor at a level approximately midway between the potentials of the separate conductors.

12. A device according to claim 8, said light sources being adapted to each emit light of a color different than that emitted by the other light source.

13. A device according to claim 8, said light sources being formed into a single unit having depending leads, said slider having a central opening in its operation portion for receiving said unit, and a pair of contactors carried by said slider, said contactors each having arms adapted to engage respective leads of said unit.

* * * * *